US008959775B2

(12) United States Patent
Yabuuchi et al.

(10) Patent No.: US 8,959,775 B2
(45) Date of Patent: Feb. 24, 2015

(54) NOSE HAIR TRIMMER

(75) Inventors: Seiko Yabuuchi, Hikone (JP); Hitoshi Ogawa, Inukami (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 322 days.

(21) Appl. No.: 13/071,263

(22) Filed: Mar. 24, 2011

(65) Prior Publication Data

US 2011/0232096 A1 Sep. 29, 2011

(30) Foreign Application Priority Data

Mar. 25, 2010 (JP) ..... 2010-071126

(51) Int. Cl.

*B26B 19/00* (2006.01)
*B26B 19/14* (2006.01)
*B26B 19/38* (2006.01)

(52) U.S. Cl.

CPC ..... *B26B 19/148* (2013.01); *B26B 19/38* (2013.01)
USPC ..... 30/29.5; 30/41; 30/41.5; 30/240

(58) Field of Classification Search

USPC ..... 30/29.5, 41.5, 41, 43.4, 43.5, 43.6, 240, 30/263, 264
See application file for complete search history.

(56) References Cited

U.S. PATENT DOCUMENTS 3,731,379 A * 5/1973 Williams ..... 30/29.5
5,012,576 A * 5/1991 Johannesson ..... 30/29.5
5,695,510 A * 12/1997 Hood ..... 606/169
6,067,714 A 5/2000 Taylor et al.
7,152,323 B1 * 12/2006 Lin ..... 30/29.5
2005/0028369 A1 * 2/2005 Cocchiarella et al. ..... 30/29.5
2007/0028447 A1 * 2/2007 Ogawa et al. ..... 30/29.5
2009/0265938 A1 10/2009 Janny et al.
2011/0232096 A1 * 9/2011 Yabuuchi et al. ..... 30/29.5

FOREIGN PATENT DOCUMENTS

CN 2007-80022828 12/2008
CN 101472715 A 7/2009
CN 2011-10081619 4/2013
EP 2298512 A1 3/2011
GB 2101031 A 6/1982

(Continued)

OTHER PUBLICATIONS

Notice of Allowance for JP 2010-071126, dated Jun. 14, 2012.

(Continued)

*Primary Examiner* — Omar Flores Sanchez
(74) *Attorney, Agent, or Firm* — Wolf, Greenfield & Sacks, P.C.

(57) ABSTRACT

A nose hair trimmer that facilitates removal of clipped hair from a blade. A main body case of the nose hair trimmer includes an interior chamber, a disposal opening, and a ring-shaped shutter. The interior chamber accommodates an inner blade rotor, which supports an inner blade, and collects clipped nose hair. The disposal opening communicates the chamber with the exterior. The shutter opens and closes the disposal opening. The shutter includes a communication portion, which communicates the interior chamber and disposal opening to the exterior. The position of the shutter in the circumferential direction when the disposal opening is closed is set as a reference position, and the shutter opens the disposal opening when rotated from the reference position by an amount that is less than one complete rotation.

7 Claims, 7 Drawing Sheets

(56) References Cited

FOREIGN PATENT DOCUMENTS

| | | |
|---|---|---|
| JP | 57-143071 | 9/1982 |
| JP | 59-16060 | 5/1984 |
| JP | 61-37189 | 2/1986 |
| JP | 2007-044081 | 2/2007 |
| JP | 4203670 | 10/2008 |

OTHER PUBLICATIONS

Chinese Office Action application No. 2011-10081619 dated Apr. 2, 2013.

* cited by examiner

NOSE HAIR TRIMMER

CROSS-REFERENCE TO RELATED APPLICATIONS

This application is based upon and claims the benefit of priority from prior Japanese Patent Application No. 2010-071126, filed on Mar. 25, 2010, the entire contents of which are incorporated herein by reference.

BACKGROUND OF THE INVENTION

The present invention relates to a nose hair trimmer having a washable structure.

Japanese Patent No. 4203670 describes a nose hair trimmer that includes a blade unit, which is inserted into a nostril by a user. The blade unit of such a nose hair trimmer includes an outer blade (fixed blade), which is cylindrical and suitable for insertion into a nostril, and an inner blade (movable blade), which is accommodated in the outer blade. The inner blade is driven and rotated by a drive source in the outer blade. The nose hair trimmer includes a retainer, which receives the inner blade and also functions to collect clipped nose hair. The user periodically removes the clipped nose hair from a main body of the nose trimmer to keep the nose hair trimmer clean.

SUMMARY OF THE INVENTION

The inner blade and a support for the inner blade each have a complex shape. Thus, a large amount of clipped nose hair gets caught in the inner blade and support. This makes it difficult to sufficiently remove the clipped nose hair even when using a cleaning brush.

To solve this problem, a nose hair trimmer may include a blade unit that can be disassembled together with peripheral components. This allows for each component to be washed with a washing liquid, such as water. However, the inner blade and its support are relatively small and sharp components. Thus, these components are difficult to handle and causes the disassembling and washing to be burdensome.

Japanese Laid-Open Utility Model Patent Publication No. 59-16060 describes a rotary dry type shaver that includes a rotatable shutting mechanism, which includes a disposal opening that can communicate with a disposal unit. The shutting mechanism is arranged on an outer blade holder, which is attached to a main body. To remove whiskers from the main body with a washing liquid, the outer blade holder is rotated in a direction in which it is separated from the main body to communicate the disposal opening with the disposal unit. This releases the whiskers together with the washing liquid from the disposal opening. Thus, the whiskers are removed from the shaver without the need for completely separating the outer blade holder from the main body.

The structure described in Japanese Laid-Open Utility Model Patent Publication No. 59-16060 may be applied to a nose hair trimmer. However, with such a structure, the position of the disposal unit differs from the position of the disposal opening in the axial direction (vertical direction). Thus, to communicate the disposal unit and disposal opening, a plurality of complete rotations must be made with the outer blade holder. This causes the washing to be burdensome and thus leaves room for improvements.

Accordingly, it is an object of the present invention to provide a nose hair trimmer that easily cleans clipped nose hair from a blade.

SUMMARY OF THE INVENTION

One aspect of the present invention is a nose hair trimmer including a case, an outer blade supported by the case and including an opening, an inner blade rotor including an inner blade accommodated in the outer blade and an inner blade base supporting the inner blade, and a drive source that rotates the inner blade rotor to clip nose hair between the outer blade and the inner blade. The case includes an interior chamber that accommodates the inner blade rotor and collects clipped nose hair. A disposal opening communicates the interior chamber with the exterior. A ring-shaped shutter is rotatably coupled to the case to open and close the disposal opening when rotated. The shutter includes a communication portion that communicates the disposal opening and the interior chamber with the exterior. A reference position is set for the shutter at a position in a circumferential direction at which the communication portion is in non-communication with the disposal opening. The communication portion comes into communication with the disposal opening when the shutter is rotated from the reference position by an amount that is less than one complete rotation.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

A nose hair trimmer 10 according to one embodiment of the present invention will now be discussed with reference to the drawings.

Figure 1:
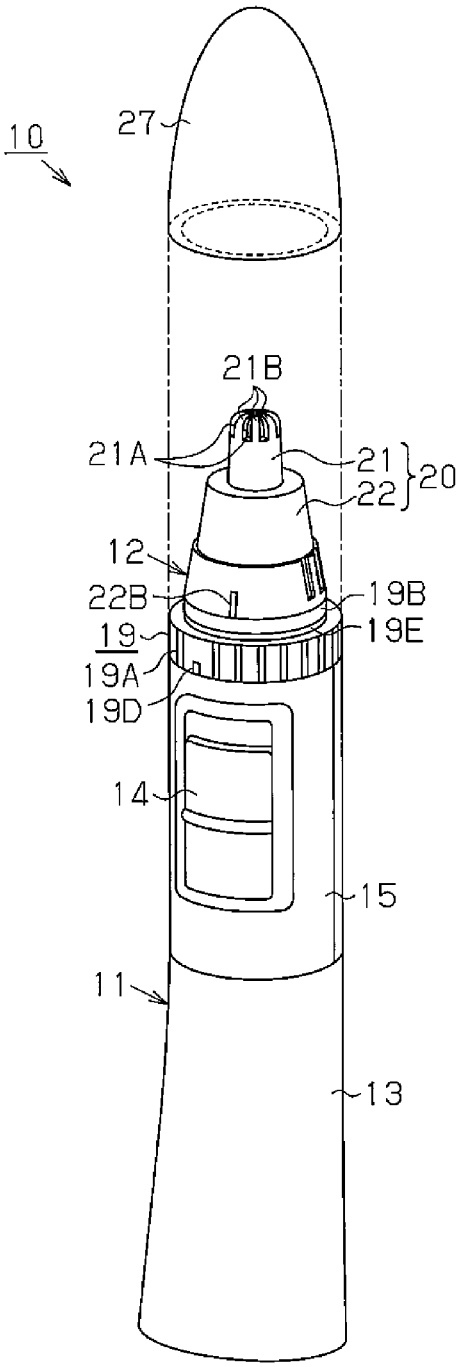
FIGS. 1(*a*) and 1(*b*) are perspective views showing the nose hair trimmer.
Figure 1:
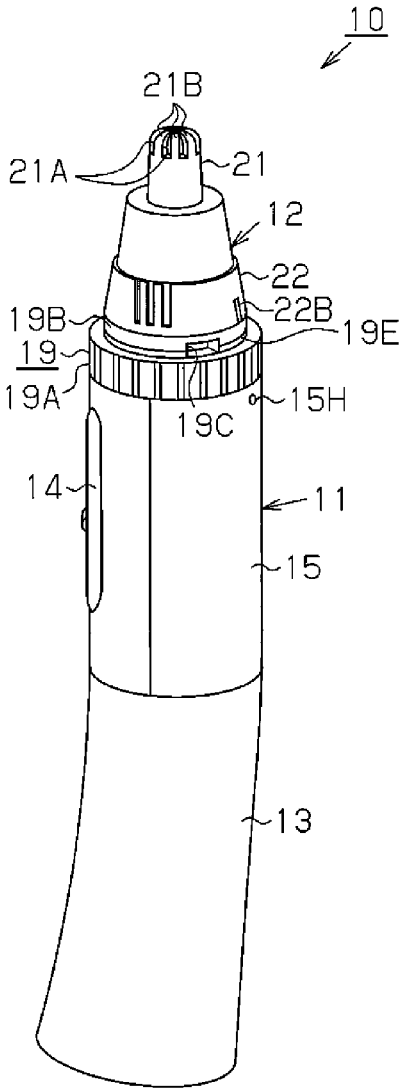

FIGS. 1(*a*) and 1(*b*) show the nose hair trimmer 10 of the present embodiment. A blade protection cap is not shown in FIG. 1(*b*).

As shown in FIGS. 1(*a*) and 1(*b*), the nose hair trimmer 10 has an overall shape that is long and cylindrical. The nose hair trimmer 10 includes a main body 11, which is for grasping by a user's hand, and a blade unit 12 arranged on one of the longitudinal ends, or distal end, of the main body 11. A grip 13 is arranged in the other one of the longitudinal ends, or basal end, of the main body 11. The grip 13 has a shape that allows for easy gripping. A slide switch 14 is arranged at the middle of the main body 11 next to the grip 13. The switch 14 has a waterproof structure and is coupled to a main body case 15, which functions as a shell for the main body 11.

Figure 3:
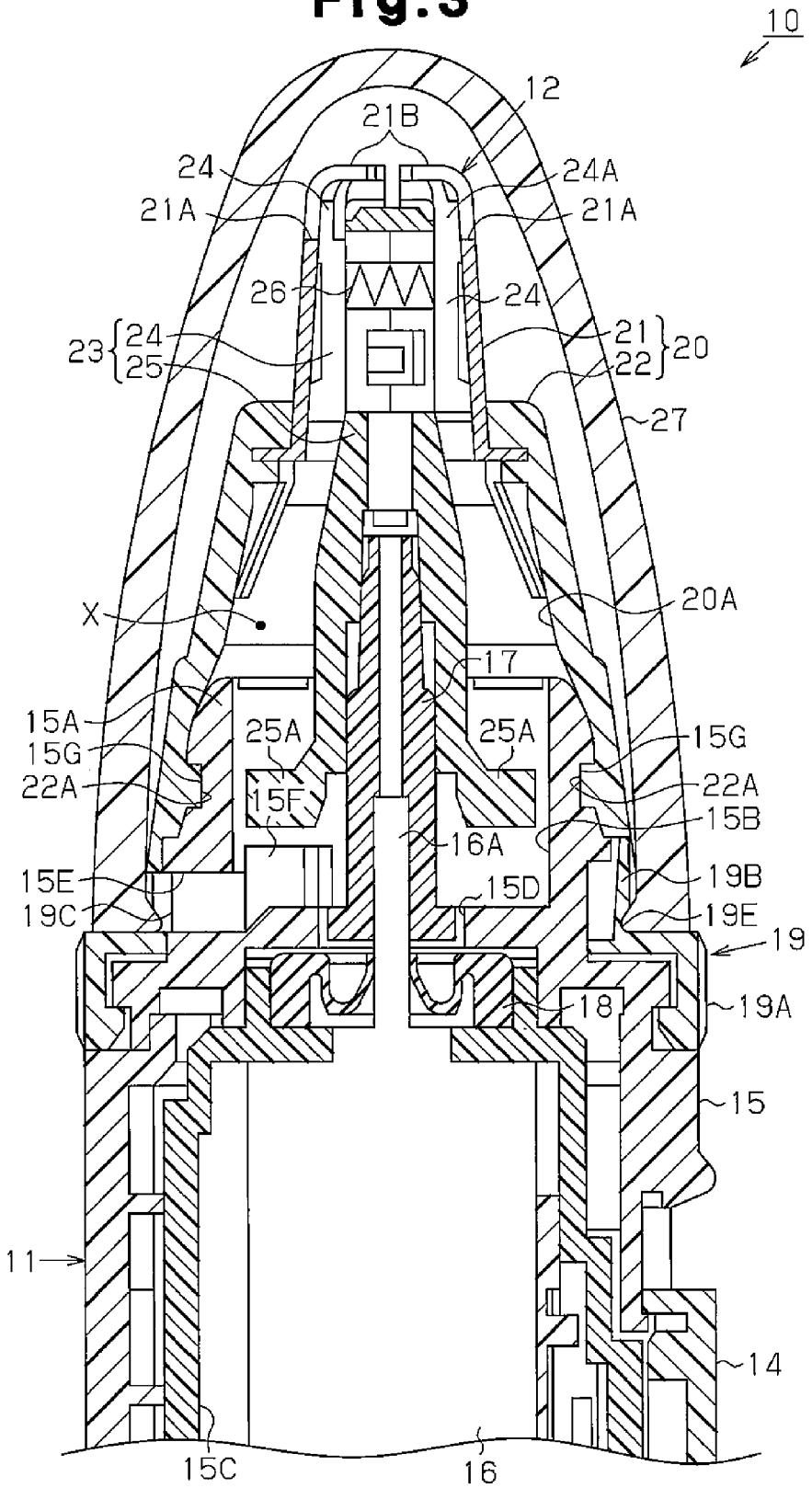
FIG. 3 is a cross-sectional view showing the blade unit and its surrounding in the nose hair trimmer.

Referring to FIG. 3, a drive motor 16 is accommodated in the main body 11 (main body case 15). More specifically, the drive motor 16 is arranged at the middle part of the main body 11 (i.e., inner side of the switch 14) so that a rotary shaft 16A of the drive motor 16 extends in a longitudinal direction of the main body 11. A battery (not shown), which supplies power to the drive motor 16, is arranged in the grip 13 of the main body 11. When the switch 14 is turned on, the battery supplies the drive motor 16 with power.

Figure 2:
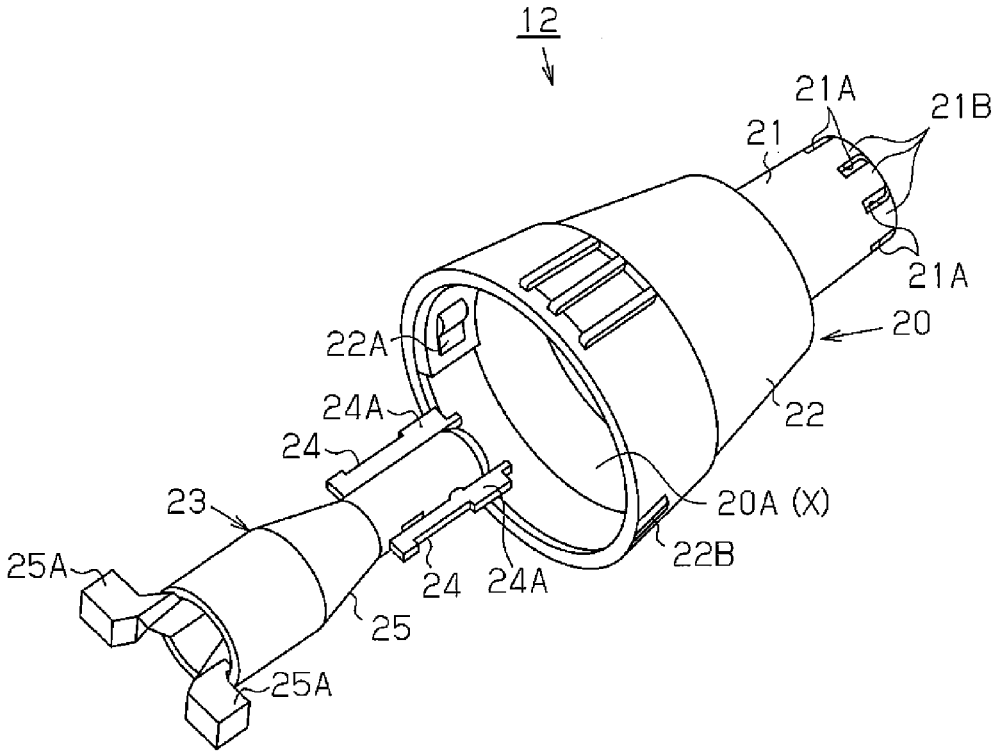
FIG. 2 is an exploded perspective view showing a blade unit of the nose hair trimmer.

The rotary shaft 16A of the drive motor 16 projects toward the distal end of the main body 11 at which the blade unit 12 is arranged. A coupling 17 is fitted and fixed to the rotary shaft 16A. The rotary shaft 16A is made of metal, and the coupling 17 is made of resin. An inner blade rotor 23, which forms part of the blade unit 12, is coupled to a distal portion of the coupling 17. The inner blade rotor 23 rotates integrally with the coupling 17 and is removable from the coupling 17. As shown in FIG. 2, the blade unit 12 includes an outer blade body 20 and the inner blade rotor 23. The outer blade body 20 includes an outer blade frame 22 and an outer blade 21 (fixed blade) attached to the outer blade frame 22. The inner blade rotor 23 includes an inner blade base 25 and inner blades 24 (movable blade) attached to the inner blade base 25.

Figure 4A:
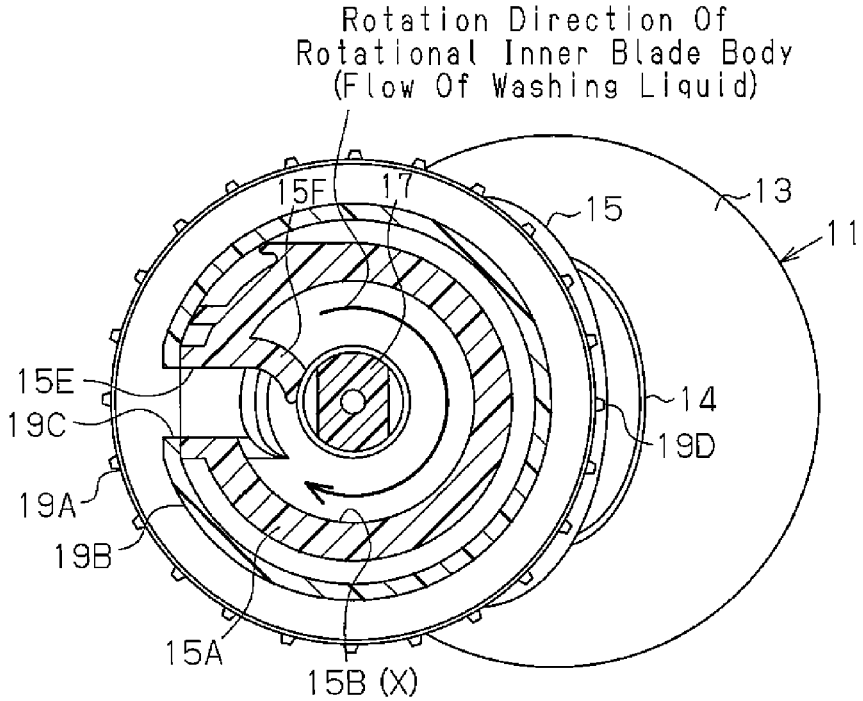
FIGS. 4(*a*) and 4(*b*) are explanatory diagrams illustrating a disposal opening of the nose hair trimmer.
Figure 4B:
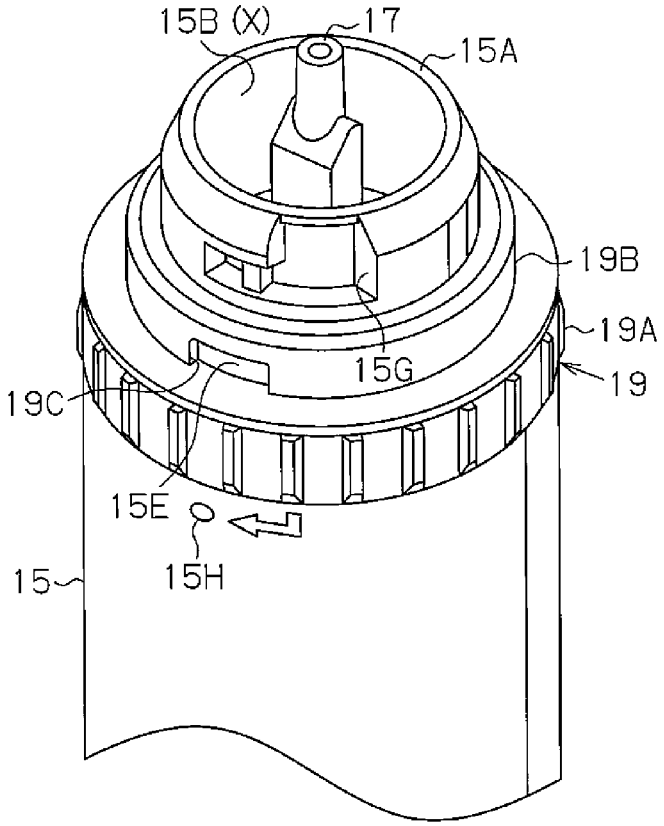

As shown in FIGS. 3 and 4, an annular attachment 15A is formed by a distal portion of the main body case 15. The outer blade frame 22 is fitted onto the attachment 15A. A cavity 15B is defined in the attachment 15A. The cavity 15B extends over a length that is slightly greater than the height of the attachment 15A. The cavity 15B is in communication with an inner blade retainer 20A, which is defined in the outer blade body 20, to form an interior chamber X, which also functions to collect clipped nose hair.

As shown in FIG. 3, the cavity 15B has a bottom wall that partitions the cavity 15B from a motor retainer 15C, which accommodates the drive motor 16. An insertion hole 15D extends through the center of the bottom wall. The rotary shaft 16A and the coupling 17 extend through the bottom surface. An M-shaped packing 18 is arranged in the motor retainer 15C near the insertion hole 15D to seal the space between the rotary shaft 16A of the drive motor 16 and the main body case 15. The packing 18 prevents foreign matter in the interior chamber X, such as clipped nose hair and washing liquid, from reaching the rotary shaft 16A and the drive motor 16 through the insertion hole 15D.

The main body case 15 includes a disposal opening 15E, which is in communication with the cavity 15B and arranged near the attachment 15A. Thus, the disposal opening 15E is in communication with the interior chamber X. Further, the disposal opening 15E is arranged 180° opposite to the switch 14 and opens outward. A ring-shaped shutter 19 is attached to the main body case 15 to open and close the disposal opening 15E.

When viewing the cavity 15B from above as shown in FIG. 4(*a*), a wall 15F extends toward the coupling 17 from a wall forming part of the disposal opening 15E. The wall 15F is connected to an inner surface of the attachment 15A and the bottom surface of the cavity 15B. The wall 15F has an inner edge in the radial direction extending to near the periphery of the disposal opening 15E (near the outer surface of the coupling 17).

As shown in FIGS. 2 and 3, the outer blade 21, which is cylindrical and suitable for insertion into the nostril of a user, is fixed to a distal portion of the outer blade frame 22, which is conical. The outer blade frame 22 has a basal portion fitted onto the attachment 15A, which is defined by the distal portion of the main body 11 (main body case 15). Two engagement projections 22A, which are arranged at opposing positions separated by 180°, are formed on an inner surface of outer blade frame 22 at the basal portion. Two engagement grooves 15G are formed on an outer surface of the attachment 15A in the main body 11 in correspondence with the two engagement projections 22A. The outer blade frame 22 is rotated to engage the engagement projections 22A and the engagement grooves 15G. The outer blade frame 22 (outer blade body 20) is attached to the attachment 15A in a removable manner.

As shown in FIG. 3, the outer blade 21 is cylindrical and has a distal end that is bent slightly inward. More specifically, the outer blade 21 includes a plurality of teeth 21B, each having a distal end bent toward the center of a distal surface of the outer blade 21. The teeth 21B form a plurality of slits 21A, which extend radially from the center of the distal surface of the outer blade 21 to the peripheral surface of the outer blade 21. The inner blade retainer 20A, which rotatably retains the inner blade rotor 23, is defined inside the outer blade body 20 (the outer blade 21 and the outer blade frame 22).

The inner blade rotor 23 includes the cylindrical inner blade base 25 and the two inner blades 24, which are formed by metal plates attached to the distal outer surface of the inner blade base 25 at opposing positions separated by 180°. The inner blade base 25 is coupled by the coupling 17 to the rotary shaft 16A of the motor 16. The inner blade rotor 23 is arranged in the inner blade retainer 20A of the outer blade body 20. A spring 26 applies urging force to the inner blades 24. This presses a cutting edge 24*a* of each inner blade 24 against the inner surface of the outer blade 21.

The inner blade base 25 includes two holding pieces 25A, which are arranged at opposing positions separated by 180° on a basal portion of the inner blade base 25. Each holding piece 25A extends from a basal end of the inner blade base 25 in a direction perpendicular to the axial direction of the inner blade base 25 (axial direction of the rotary shaft 16A). That is, the two holding pieces 25A linearly extend radially outward in opposite directions. Each holding piece 25A includes a tetragonal cross-section. More specifically, the tetragonal cross-section of each holding piece 25A includes two sides extending in a direction perpendicular to the axial direction of the rotary shaft 16A and two sides extending in the axial direction of the rotary shaft 16A. Each holding piece 25A has a shape that allows for easy holding with fingers when someone, such as a user, handles the inner blade base 25 (inner blade rotor 23).

The two holding pieces 25*a* of the inner blade base 25 function as water flow vanes when rotated with the inner blade rotor 23. More specifically, as shown in FIG. 3, the holding pieces 25A are attached to the inner blade rotor 23 (inner blade base 25) so that an upper wall of the disposal opening 15E of the main body case 15 is located slightly below a basal end of each holding piece 25A. When the rotation of the inner blade rotor 23 rotates the holding pieces 25A, the layout of the holding pieces 25A and the disposal opening 15E produces a fluid flow directed from the slits 21A of the outer blade 21 to the interior chamber X and then toward the disposal opening 15E.

As shown in FIGS. 1(*a*), 1(*b*), and 3, the shutter 19, which is rotatable when attached to the main body case 15, includes a ring-shaped operation member, or knob 19A, which is operated by the user. The shutter 19 also includes a ring-shaped cover 19B arranged above and inward from the knob 19A. The cover 19B is located between the outer blade frame 22 and the main body case 15. Ribs are formed on the outer surface of the knob 19A. The cover 19B includes a communication portion 19C, which is a hole, arranged at the same level in the axial direction (vertical direction) as the disposal opening 15E. The communication portion 19C, when viewed from above, is tetragonal and has a width in the circumferential direction that is greater than that of the disposal opening 15E.

A reference mark 19D (refer to FIG. 1A), which indicates a reference rotation position for the knob 19A, is provided on the outer surface of the knob 19A at a position 180° opposite to the communication portion 19C.

A location indicator 22B (refer to FIGS. 1A and 1B) is provided on the outer surface of the outer blade frame 22 at a position corresponding to the disposal opening 15E and at an opposing position separated by 180°. A further location indicator 15H (refer to FIG. 4(*b*)) is arranged on the main body case 15 at a position corresponding to the disposal opening 15E next to the disposal opening 15E in the longitudinal direction of the main body case 15.

The cover 19B includes a lower portion coupled to the knob 19A and defining a holding portion 19E, which holds a blade protection cap 27. The holding portion 19E has a diameter that is smaller than other portions of the cover 19B. A projection is arranged in the blade protection cap 27 at a position corresponding to the holding portion 19E and fitted into the holding portion 19E to hold the blade protection cap 27 in a state attached to the shutter 19.

During use, the switch 14 is turned on to drive the motor 16 and rotate the rotary shaft 16A. This rotates the inner blade rotor 23 and clips nose hair between blade edges 24A of the inner blade 24 and the outer blade 21. Clipped nose hair is collected in the interior chamber X, which is formed by the cavity 15B and the inner blade retainer 20A. The nose hair trimmer 10 is used with the outer blade 21 directed upward. Thus, a large amount of clipped nose hair collects in the cavity 15B. To prevent clipped nose hair from falling out of the disposal opening 15E during use, the disposal opening 15E is closed by the shutter 19.

Figure 5A:
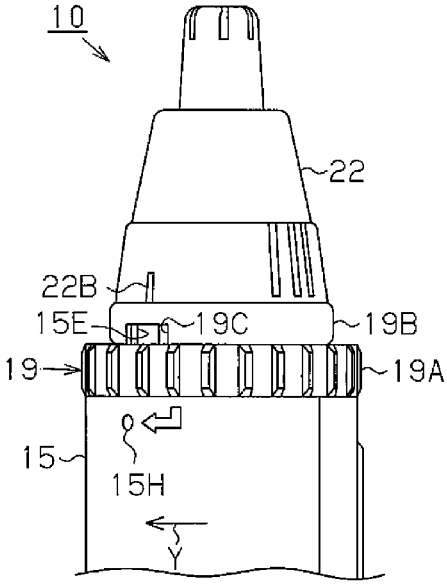
FIGS. 5(*a*) and 5(*b*) are explanatory diagrams illustrating the disposal opening of the nose hair trimmer in an open state.
Figure 5B:
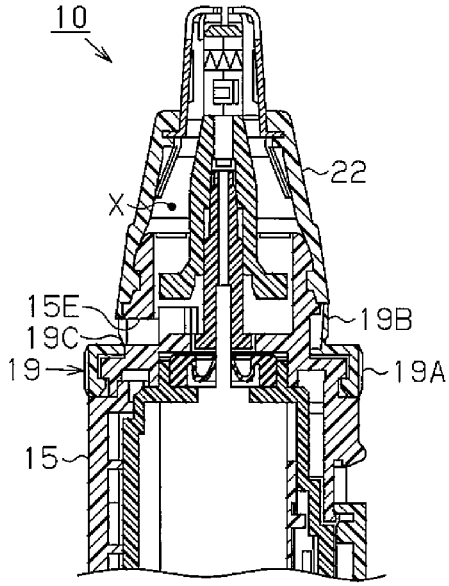
Figure 6A:
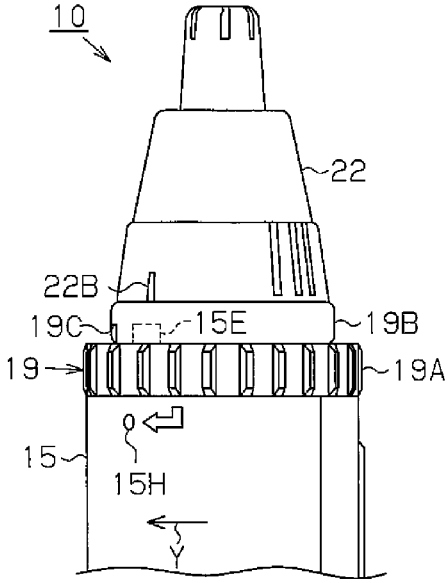
FIGS. 6(*a*) and 6(*b*) are explanatory diagrams illustrating the disposal opening of the nose hair trimmer in a closed state.
Figure 6B:
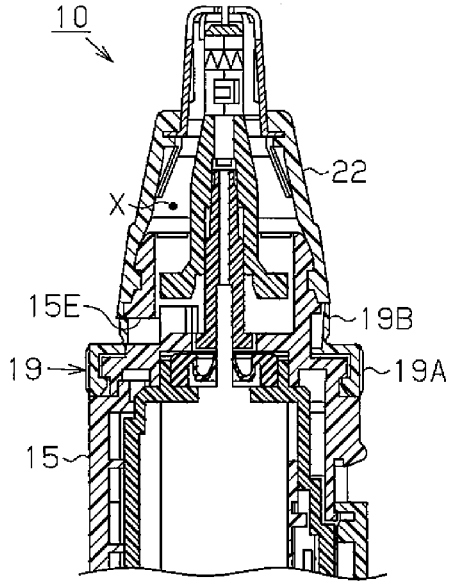

The operation of the shutter 19 will now be discussed with reference to FIGS. 5 and 6.

The shutter 19 is rotated like a dial to open and close the disposal opening 15E. More specifically, the user rotates the knob 19A in the direction indicated by arrow Y. This moves the communication portion 19C together with the knob 19A in the direction of the arrow Y. When opening the disposal opening 15E, the user operates the knob 19A to align the reference mark 19D (refer to FIG. 1(*a*)) with one of the location indicators 22B. This aligns the communication portion 19C with the other location indicator 22B and the location indicator 15H of the main body case 15. When closing the disposal opening 15E, the knob 19A is operated to separate the reference mark 19D from the location indicators 22B. In this state, the communication portion 19C is separated from the other location indicator 22B and the location indicator 15H of the main body case 15. When the disposal opening 15E is open, the interior coil X and the exterior are in communication through the disposal opening 15E as shown in FIGS. 5(*a*) and 5(*b*). When the disposal opening 15E is closed, the cover 19B shuts the interior chamber X from the exterior as shown in FIGS. 6(*a*) and 6(*b*). In this manner, the shutter 19 opens and closes the disposal opening 15E when rotated by an amount that is less than one complete rotation. Further, the knob 19A is rotatable only in the direction of the arrow Y. This direction is opposite to the direction of rotation for separating the outer blade frame 22 from the main body case 15 but the same as the direction of rotation for separating the grip 13 (refer to FIGS. 1(*a*) and 1(*b*)) from the main body case 15.

The washing of the nose hair trimmer 10 will now be discussed with reference to FIGS. 7 and 8.

Figure 7:
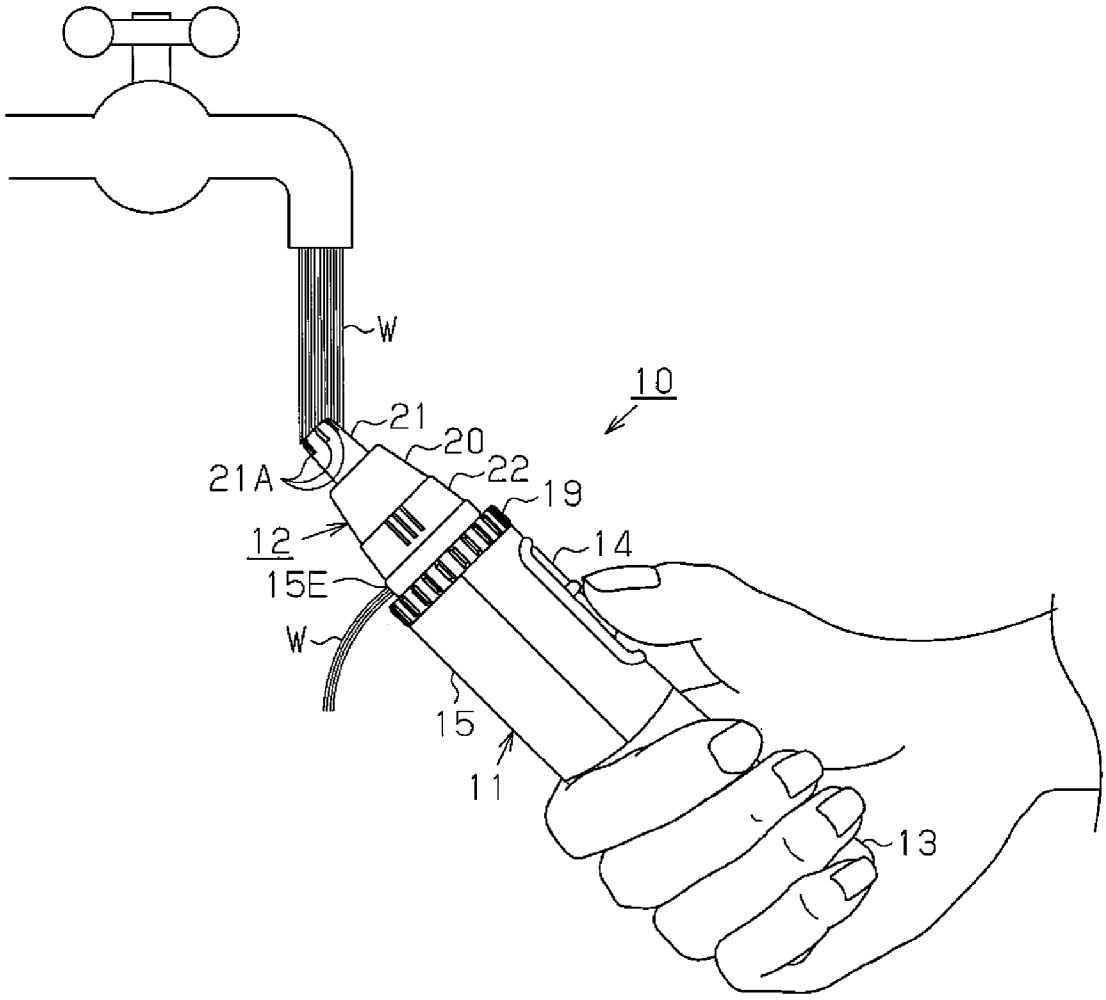
FIG. 7 is an explanatory diagram illustrating a washing example of the nose hair trimmer.
Figure 8:
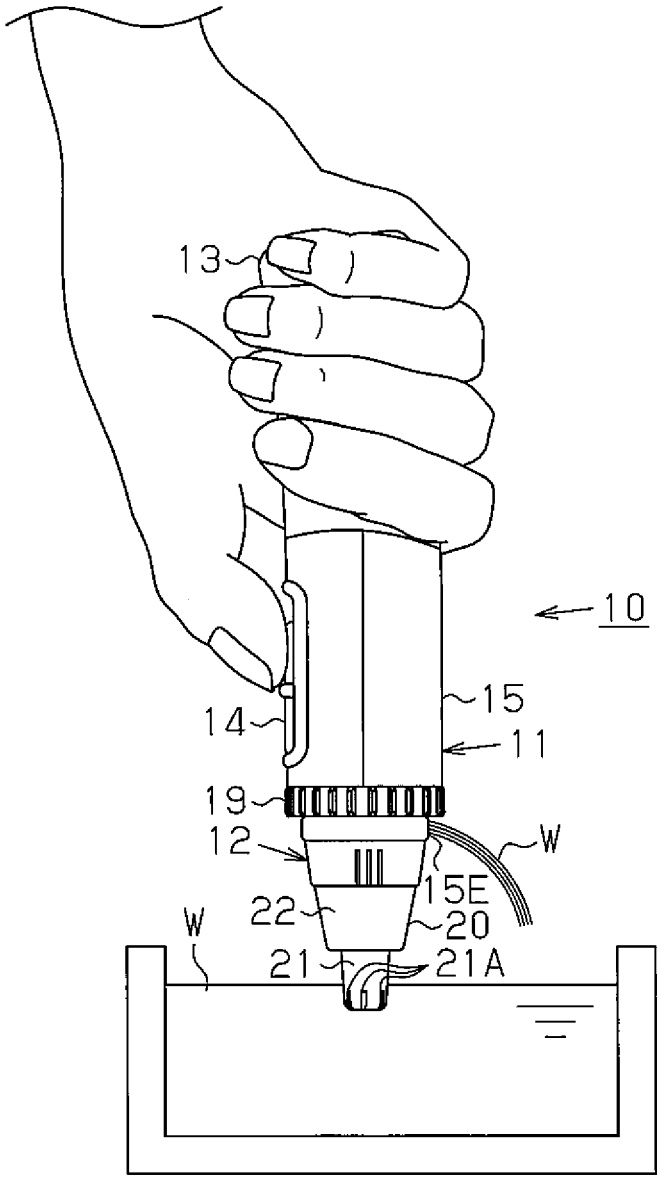
FIG. 8 is an explanatory diagram illustrating a washing example of the nose hair trimmer.

As shown in FIGS. 7 and 8, the shutter 19 is operated to open the disposal opening 15E, which is closed during use. Then, the outer blade 21 is directed upward so that washing liquid, such as water W, enters the interior chamber X through the slits 21A of the outer blade 21. This washes out the clipped nose hair collected in the blade unit 12 (for example, the clipped nose hair stuck to the inner blade rotor 23 and the inner wall of the outer blade frame 22) and the clipped nose hair is disposed of from the disposal opening 15E. In this state, the nose hair trimmer 10 may be driven to rotate the inner blade rotor 23 and produce a strong flow of water directed from the slits 21A of the outer blade 21 to the interior chamber X and toward the disposal opening 15E. Thus, the clipped nose hair is disposed of from the blade unit 12 in a further preferable manner together with the water W. In this state, the disposal opening 15E does not have to be fully open. The open amount of the disposal opening 15E, that is, the overlapping amount of the disposal opening 15E and the communication portion 19C (refer to FIGS. 1(*a*) and 1(*b*)) may be adjusted to regulate the amount of water discharged from the disposal opening 15E.

The inner blade rotor 23 is rotated during washing to produce a strong water flow in the blade unit 12. Thus, as shown in FIG. 5(*a*), when the outer blade 21 is directed downward, washing liquid (e.g., water W) is drawn into the blade unit 12 and discharged from the disposal opening 15E. This washes the interior of the blade unit 12. The washing liquid is not limited to water W and may be a liquid mixed with a washing agent.

The present embodiment has the advantages described below.

(1) In the present embodiment, the disposal opening 15E and the communication portion 19C are arranged at the same level in the axial direction (vertical direction). Thus, the shutter 19 can be rotated by an amount that is less than a one complete rotation to communicate the disposal opening 15E and the communication portion 19C with each other. Accordingly, when washing the nose hair trimmer 10, to open the disposal opening 15E, the shutter 19 need only be rotated by a small amount. This facilitates cleaning of the nose hair trimmer 10.

(2) In the present embodiment, the disposal opening 15E is arranged opposite to the switch 14. Thus, when washing the nose hair trimmer 10 as shown in FIGS. 7 and 8, the water W discharged from the disposal opening 15E does not wet one's fingers used to operate the switch 14. This facilitates washing.

(3) In the present embodiment, the grip 13 is located toward the basal side from the disposal opening 15E of the main body case 15. This separates the disposal opening 15E from the user's hand. Thus, when washing the nose hair trimmer 10 as shown in FIGS. 7 and 8, the water W is prevented from wetting one's fingers used to hold the main body case 15. This facilitates washing.

(4) In the present embodiment, when the blade protection cap 27 is attached to the shutter 19, the blade protection cap 27 covers the disposal opening 15E. This improves the aesthetic appeal of the nose hair trimmer 10.

(5) In the present embodiment, the ribs are formed on the surface of the knob 19A of the shutter 19. Thus, when the user rotates the knob 19A, the ribs function to prevent slipping from one's fingers. This improves operability.

(6) In the present embodiment, the direction in which the shutter 19 is rotated is opposite to the direction of rotation for separating the outer blade frame 22 from the main body case 15. This prevents the outer blade frame 22 from the being rotated in the separation direction when the shutter 19 is rotated.

(7) In the present embodiment, the reference mark 19D is provided on the knob 19A, and the location indicators 22B are provided on the outer blade frame 22. Thus, the user can open the disposal opening 15E by aligning the reference mark 19D with one of the location indicators 22B. Accordingly, the user can open the disposal opening 15E without directly checking the location of the disposal opening 15E. This improves the operability of the shutter 19.

(8) In the present embodiment, the shutter 19 is rotatable like a dial. Thus, the user can operate the shutter 19 regardless of the position of the shutter 19 in the circumferential direction. This facilitates the opening and closing of the disposal opening 15E with the shutter 19.

(9) In the present embodiment, the main body case 15 includes the disposal opening 15E, and the inner blade base 25 includes the two holding pieces 25A, which function as water flow vanes. When the rotation of the inner blade rotor 23 rotates the water flow vanes (holding pieces 25A), water W is directed from the slits 21A of the outer blade 21 to the interior chamber X and discharged from the disposal opening 15E. Thus, in addition to the water that flows into the nose hair trimmer 10, the rotation of the water flow vanes (holding pieces) produces a strong water flow of washing liquid. Further, the wall 15F improves the discharging ability of the disposal opening 15E. This improves washing characteristics.

The invention is not limited to the foregoing embodiments and various changes and modifications of its components may be made without departing from the scope of the present invention. Also, the components disclosed in the embodiments may be assembled in any combination for embodying the present invention. For example, some of the components may be omitted from all components disclosed in the embodiments. Further, components in different embodiments may be appropriately combined. Particularly, it should be understood that the present invention may be embodied in the following forms.

In the embodiment discussed above, the blade protection cap 27 is attached to the shutter 19. Instead, the blade protection cap 27 may be attached to the main body case 15.

In the embodiment discussed above, the disposal opening 15E is arranged opposite to the switch 14. However, the position of the disposal opening 15E in the circumferential direction is not limited in such a manner and may be changed to any position. Further, the position of the disposal opening 15E in the longitudinal direction (vertical direction) is not limited to the position shown in FIG. 3 and may be changed to any position. For example, the holding pieces 25A and the disposal opening 15E may be located at the same level in the vertical direction.

In the embodiment discussed above, there is only one disposal opening 15E. Instead, there may be more than one disposal opening 15E.

In the embodiment discussed above, the holding pieces 25A function as water flow vanes. However, such a function may be eliminated. Further, the holding pieces 25A may be wing-shaped.

In the embodiment discussed above, the reference mark 19D of the knob 19A is aligned with the location indicator 22B of the outer blade frame 22 to open the disposal opening 15E. However, the operation of the knob 19A is not limited in such a manner. For example, the knob 19A may be operated to align the location indicator 15H of the main body case 15 with the communication portion 19C. This opens the disposal opening 15E without using the reference mark 19D by operating the knob 19A to align the communication portion 19C with the location indicator 15H.

The present examples and embodiments are to be considered as illustrative and not restrictive, and the invention is not to be limited to the details given herein, but may be modified within the scope and equivalence of the appended claims.

What is claimed is:

1. A nose hair trimmer comprising:

a case;

an outer blade supported by the case and including an opening;

an inner blade rotor including an inner blade accommodated in the outer blade and an inner blade base supporting the inner blade; and a drive source that rotates the inner blade rotor to clip nose hair between the outer blade and the inner blade;

wherein the case includes:

an interior chamber that accommodates the inner blade rotor and collects clipped nose hair;

a disposal opening that communicates the interior chamber with the exterior;

a ring-shaped shutter rotatably coupled to the case to open and close the disposal opening when rotated; and a blade protection cap covering the outer blade;

wherein the shutter includes:

a cover including a communication portion that communicates the disposal opening and the interior chamber with the exterior;

a reference mark, which indicates a reference rotation position of the shutter, provided on the outer surface of the shutter, wherein there is the positional relationship between the communication portion and the reference mark so that one is visible and the other is invisible when viewed from a first side of the shutter where the communication portion is provided or a second side of the shutter where the reference mark is provided, wherein the case includes a pair of location indicators having the positional relationship therebetween so that one is visible and the other is invisible when viewed from a first side of the case where one of the pair of location indicators is provided or a second side of the case where the other one of the pair of location indicators is provided, and wherein the pair of location indicators are arranged so that when the reference mark is aligned with one of the pair of location indicators, the communication portion is aligned with the other of the pair of location indicators and the communication portion comes into communication with the disposal opening by an amount that is less than one complete rotation of the shutter from a reference position that is set for the shutter at a position in a circumferential direction at which the communication portion is in non-communication with the disposal opening; and a holding portion that holds the blade protection cap, wherein the holding portion has a diameter that is circumferentially smaller than other portion of the cover, and the blade protection cap has a projection fitted into the holding portion.

2. The nose hair trimmer according to claim 1, wherein:

the case includes a holding portion held by a user;

the inner blade rotor includes a water flow vane;

the case includes a power switch that switches the drive source on and off; and the disposal opening and the power switch are located at different positions.

3. The nose hair trimmer according to claim 2, wherein the grip is cylindrical, and the grip and the outer blade are located at opposite sides of the disposal opening.

4. The nose hair trimmer according to claim 1, wherein the reference mark is arranged 180° opposite to the communication portion, and the pair of location indicators are arranged at a position 180° opposite to each other.

5. The nose hair trimmer according to claim 1, wherein:

the case includes an outer blade frame that fixes the outer blade and includes an inner blade retainer, which accommodates the inner blade rotor; and the outer blade frame includes the location indicators indicating where the disposal opening is located.

6. The nose hair trimmer according to claim 5, wherein:

the outer frame is attached to the case in a manner that the outer frame is removable from the case when rotated in a first direction; and the shutter is attached to the case and rotatable in a second direction, which is opposite the first direction.

7. The nose hair trimmer according to claim 2, wherein:

the reference mark and one of the pair of the location indicators are located at sides of the power switch and the communication portion and the other of the pair of the location indicators are located at opposite sides of the power switch.

* * * * *